US007420109B2

(12) United States Patent
Wasser et al.

(10) Patent No.: US 7,420,109 B2
(45) Date of Patent: Sep. 2, 2008

(54) MUSICAL INSTRUMENT TONE HOLE FORMING TOOL AND METHOD

(75) Inventors: Steven Wasser, Wellesley, MA (US); Bohumir Zmrzly, Canton, MA (US)

(73) Assignee: Verne Q. Powell Flutes, Inc., Maynard, MA (US)

( * ) Notice: Subject to any disclaimer, the term of this patent is extended or adjusted under 35 U.S.C. 154(b) by 76 days.

(21) Appl. No.: 11/543,612

(22) Filed: Oct. 5, 2006

(65) Prior Publication Data

US 2008/0083315 A1 Apr. 10, 2008

(51) Int. Cl.
*G10D 7/00* (2006.01)
*B21D 31/02* (2006.01)

(52) U.S. Cl. ..... 84/385 R; 84/380 R; 84/384; 72/370.27

(58) Field of Classification Search ..... 84/384, 84/380 R, 385 R; 29/896.2, 896.22; 72/370.27, 72/112
See application file for complete search history.

(56) References Cited

U.S. PATENT DOCUMENTS 1,119,954 A * 12/1914 Haynes ..... 84/380 R
1,153,489 A * 9/1915 Hardy ..... 29/896.22
1,432,279 A * 10/1922 Christensen ..... 29/896.22
1,455,440 A * 5/1923 Hofinger ..... 29/896.22
1,529,430 A * 3/1925 Gulick ..... 72/125
1,673,195 A * 6/1928 Johnson ..... 84/380 R
1,690,862 A * 11/1928 Johnson ..... 84/385 R
1,805,449 A * 5/1931 Gulick ..... 84/382
2,507,859 A * 5/1950 Keller ..... 29/890.15
3,451,113 A * 6/1969 Holden ..... 29/890.148
3,535,909 A * 10/1970 Latham ..... 72/370.27
3,683,657 A * 8/1972 Davies ..... 72/112
3,884,060 A * 5/1975 Larikka ..... 72/20.4
4,132,097 A * 1/1979 Ames ..... 72/71
4,389,866 A * 6/1983 Larikka ..... 72/71
4,400,959 A * 8/1983 Reigner et al. ..... 72/112
4,503,693 A * 3/1985 Larikka ..... 72/71
4,998,456 A * 3/1991 Kahonen ..... 84/384
5,183,954 A 2/1993 Wasser
5,297,466 A 3/1994 Wasser
5,381,718 A 1/1995 Wasser
5,469,771 A 11/1995 Wasser
6,430,812 B1 * 8/2002 Sanders ..... 29/890.148
6,612,020 B2 * 9/2003 Sanders ..... 29/715

(Continued)

OTHER PUBLICATIONS

Tech Topic; Saxophone Tone Holes, CyperSax Tech Topics Vintage and Pro Saxophones, viewed Feb. 13, 2008, http://www.cybersax.com/Tone_Holes.html.*

(Continued)

*Primary Examiner*—Lincoln Donovan
*Assistant Examiner*—Robert W Horn
(74) *Attorney, Agent, or Firm*—Iandiorio Teska & Coleman

(57) ABSTRACT

A novel musical instrument tone hole forming tool. A body includes a distal end to be inserted transversely into a musical instrument through an opening therein. The distal end of the body includes sockets spaced about its periphery. Bearings are located in the sockets. A shaft is moveable within the body and includes reduced diameter distal portions which receive the bearings in a contracted configuration in order to insert the body into the musical instrument. The shaft drives the bearings outward from the distal end of the body in an expanded configuration to form the tone hole when the body is withdrawn out of the musical instrument.

11 Claims, 6 Drawing Sheets

U.S. PATENT DOCUMENTS

| | | | | |
|---|---|---|---|---|
| 6,840,079 | B2 * | 1/2005 | Jorgenson et al. | 72/335 |
| 6,852,917 | B2 * | 2/2005 | McAleenan | 84/380 R |
| 6,860,517 | B2 * | 3/2005 | Sanders | 285/133.11 |
| 2008/0083315 | A1 * | 4/2008 | Wasser et al. | 84/380 R |

OTHER PUBLICATIONS

Keilwerth Saxophones (feature rolled sound holes) © 2005 Robert Haley, Classic Saxophone Online, http://shop.classicsax.com/tek9.asp?pg=keilwerthsound.*

P. Mauriat Saxophone (feature rolled sound holes), viewed Feb, 13, 2008. http://www.pmauriatmusic.com/PMXA-67R-mainpage.htm.*

Modern Saxophone Manufacturing (tone hole extruding), Stan Garber, Selmer, © 2004, viewed Feb. 13, 2007, http://www.saxgourmet.com/PaulCoatsArticles/modern_saxophone_manufacturing.htm.*

* cited by examiner

MUSICAL INSTRUMENT TONE HOLE FORMING TOOL AND METHOD

FIELD OF THE INVENTION

This subject invention relates to musical instruments and, in particular, a tone hole forming tool and method.

BACKGROUND OF THE INVENTION

Musical instruments such as flutes, saxophones, and piccolos have tone holes. Forming these tone holes is a craft often involving numerous steps, the use of different machinery, and different jigs, fixtures, and tools.

In one example in accordance with the state of the art, a computerized numerical control (CNC) machine is used to drill pre-opening holes in the flute body. The holes could also be punched. The flute body is removed from the CNC machine and taken to an extrusion station. There, an arbor is inserted into the flute body and a pulling ball is loaded in the arbor. The flute tube is then slid over the loaded arbor. The flute and loaded arbor are then placed on an extrusion machine which contains a die or "chimney" directly over the hole in the flute tube and the loaded pulling ball. A shaft is then connected to the pulling ball through the hole drilled in the flute body. The shaft is connected to the extrusion machine which then rotates the pulling ball and urges it out of the flute body through the chimney to form the tone hole. The remainder of the tone holes are formed in this same way. Next, the flute body is returned to the CNC machine where the tops of all the tone holes are machined flat ("faced") to render them level. Finally, the edges of the tone hole are rolled out to finish the tone hole.

Thus, forming tone holes requires the use of different machinery, different jigs and fixtures, and different tools resulting in a time consuming and costly process. Also, since the configuration of the tone holes is critical, there is the possibility of inaccuracies and intolerances where certain dimensions of the tone hole do not meet specifications each time the flute body is moved and/or fitted with a different arbor.

SUMMARY OF THE INVENTION

It is therefore an object of this invention to provide a new musical instrument tone hole forming tool and method.

It is a further object of this invention to provide such a tool and such a method which reduces the number of different machines used in forming a tone hole.

It is a further object of this invention to provide such a tool and method which, in one preferred embodiment, enables a single machine to be used to perform all the primary steps associated with forming a tone hone in a musical instrument.

It is a further object of this invention to provide such a forming tool and method which reduces the number of different jigs and fixtures used in forming tone holes.

It is a further object of this invention to provide such a tool and method which results in more accurate and better quality tone holes.

It is a further object of this invention to provide such a tool and method which results in a substantial labor and cost savings.

The subject invention results from the realization that, in one preferred embodiment, a single CNC machine can be used to form the tone holes in a musical instruments such as a flute via a new forming tool with a variable configuration working end: contracted so it can be inserted transversely into the musical instrument body and then expanded to form the tone hole as the tool is withdrawn from the instrument body.

The subject invention, however, in other embodiments, need not achieve all these objectives and the claims hereof should not be limited to structures or methods capable of achieving these objectives.

In a preferred embodiment, the musical instrument tone hole forming tool of the subject invention features a body including a distal end to be inserted transversely into a musical instrument through an opening therein. The distal end of the body includes sockets spaced about its periphery with bearings located in the sockets. A shaft is moveable within the body and includes reduced diameter distal portions which receive the bearings in a contracted configuration in order to insert the body into the musical instrument. The shaft drives the bearings outward from the distal end of the body in an expanded configuration to form a tone hole when the body is withdrawn out of the musical instrument. Typically, the ball shaped bearings are flush with the periphery of the body when received in the reduced diameter portions of the shaft. In one example, the reduced diameter distal portions of the shaft are configured as a continuous groove extending circumferentially around the distal end of the shaft.

In one specific example, the body has an outer diameter of 0.500 inches, an inner diameter of 0.250 inches, the shaft has an outer diameter of 0.250 inches, and the bearings are balls 0.156 inches in diameter. Typically, the body, the shaft, and the bearings are made of metal.

One method of forming a tone hole in a musical instrument in accordance with the subject invention includes forming an opening transversely through the body of the musical instrument. A forming tool with a variable diameter distal end is inserted into the opening with the distal end in a contracted configuration. The forming tool is then reconfigured into its expanded configuration and withdrawn out of the musical instrument body through a chimney to form a tone hole.

Typically, the step of forming an opening includes drilling a hole in the body of the musical instrument and using a performing tool to form an approximation of a tone hole. The tone hole may be machined and the edges rolled after the tone hole is formed. Preferably, all of these steps are carried out in a computerized numerical control machine.

The preferred forming tool includes a shaft including a distal end to be inserted into a musical instrument through the opening, the distal end of the body including sockets spaced about its periphery, bearings in the sockets, and a shaft moveable within the body including reduced diameter distal portions which receive the bearings in a contracted configuration in order to insert the body into the musical instrument, the shaft driving the bearings outward from the distal end of the body in an expanded configuration to form the tone hole when the body is withdrawn from the musical instrument.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
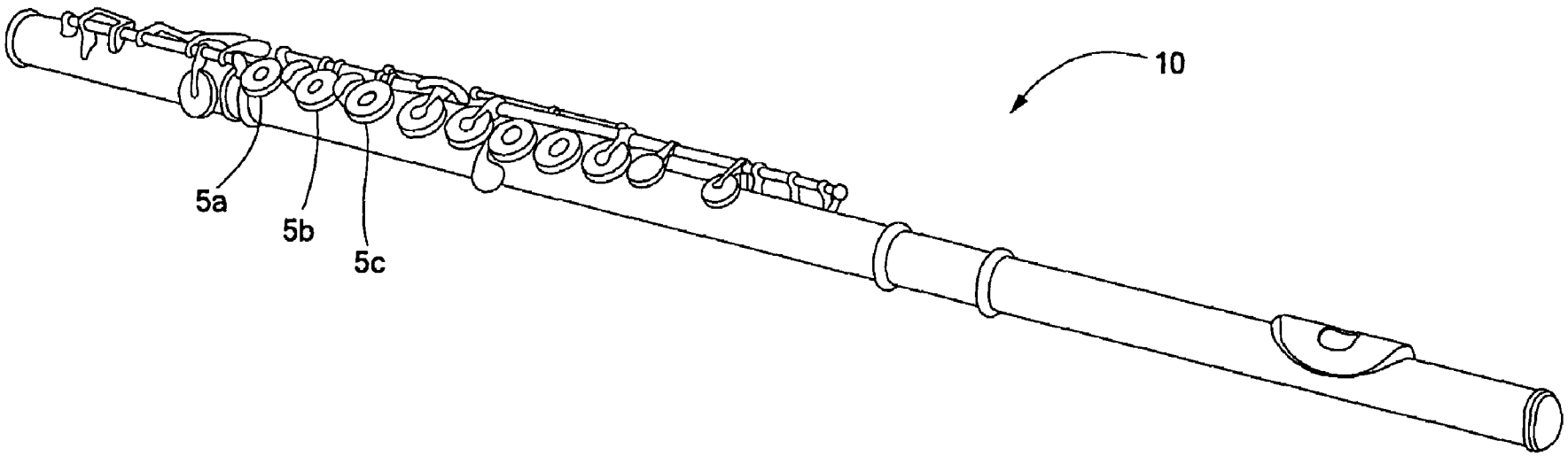
FIG. 1 is a schematic three-dimensional view showing a typical flute and the tone holes associated therewith.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2A:
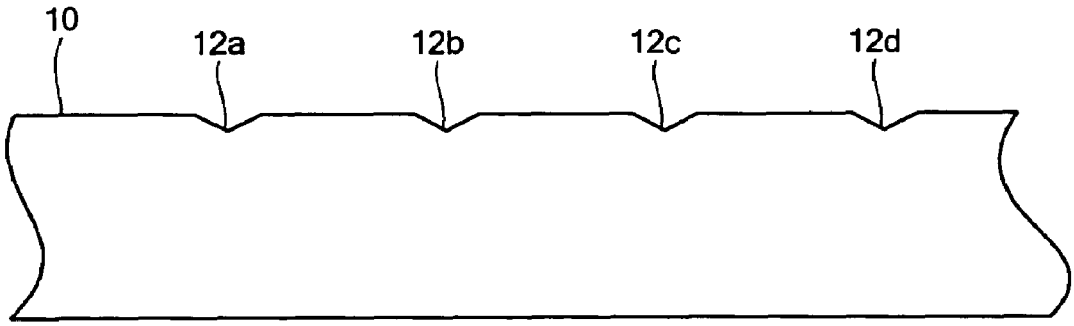
FIG. 2A (PRIOR ART)
FIG. 2A is a schematic side view showing the formation of pre-opening holes drilled in a flute body.
Figure 2B:
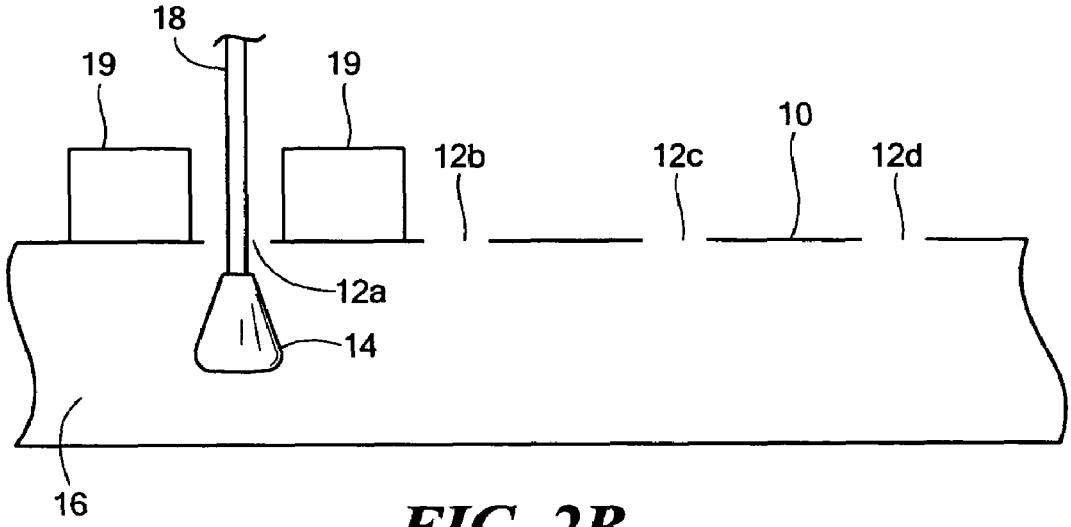
FIG. 2B (PRIOR ART)
FIG. 2B is a schematic cross-sectional view showing how a pulling ball is used to form a tone hole in a flute body in accordance with the prior art.
Figure 2C:
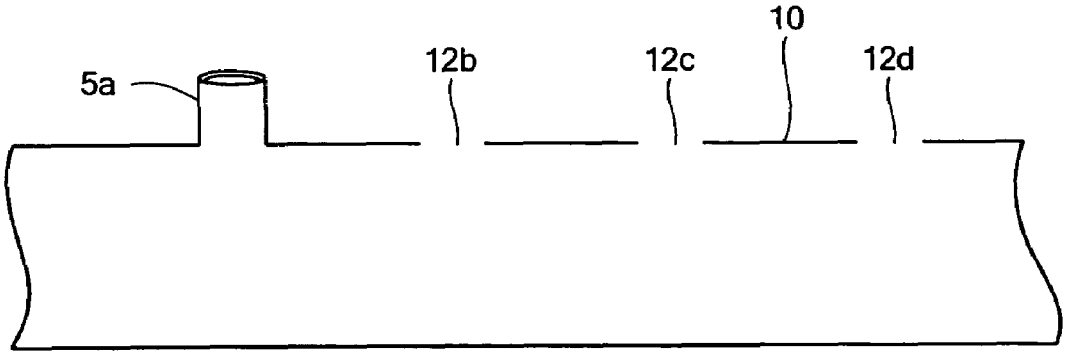
FIG. 2C (PRIOR ART)
FIG. 2C is a schematic view showing how a tone hole has now been formed using the pulling ball shown in FIG. 2B.

FIG. 1 shows flute 10 with tone holes 5*a*-5*c*. The configuration of tone holes 5*a*-5*c* is critical for high quality flutes. In the prior art, a CNC machine is used to drill pre-opening holes 12*a*-12*d*, FIG. 2A in flute body 10. The holes could also be punched. Flute body 10 is then removed from the CNC machine and taken to an extrusion station. There, an arbor (not shown) is placed in flute body 10 and pulling ball 14, FIG. 2B is placed in the flute body through open end 16. Chimney 19 is used as a forming die. Shaft 18 is then threaded onto pulling ball 14 through hole 12*a* in flute body 10 and shaft 18 is connected to a press machine which then rotates pulling ball 14 and urges it out of the flute body to form tone hole 5*a*, FIG. 2C. The remainder of the tone holes are formed in the same way with pulling balls individually pulled up through pre-opening holes 12*b*, 12*c* and 12*d*. Next, the flute body is returned to the CNC machine where the tops of all the tone holes are machined ("faced") to render them level. Finally, the edges of the tone holes are rolled outwardly to finish them.

Thus, forming tone holes requires the use of different machinery, different jigs and fixtures, and different tools resulting in a time consuming and costly process. Also, since the configuration of the tone holes is critical, there is the possibility of inaccuracies and dimensions which do not meet specifications each time the flute body is moved, fitted with a different arbor, and/or loaded into a machine or press.

Figure 3A:
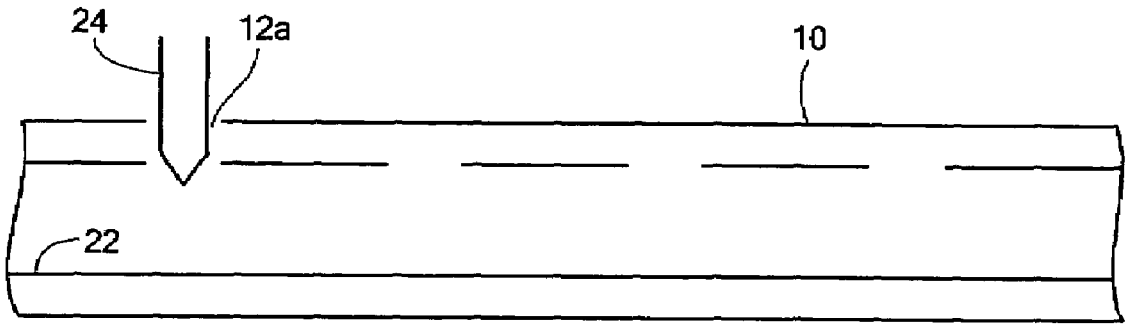
FIG. 3A is a schematic cross-sectional view showing how the pre-opening holes are formed in a flute body in accordance with the subject invention.
Figure 3B:
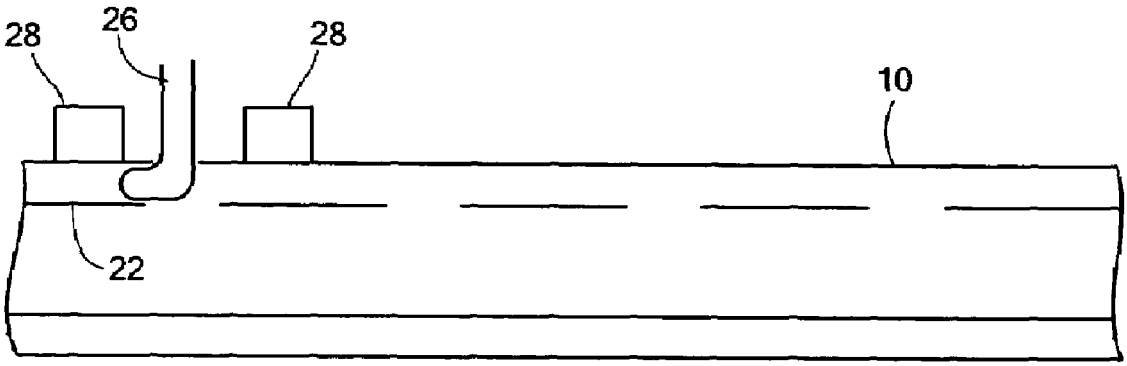
FIG. 3B is a schematic cross-sectional view showing how a pre-forming tool is used to form a tone hole approximation in accordance with the subject invention.
Figure 3C:
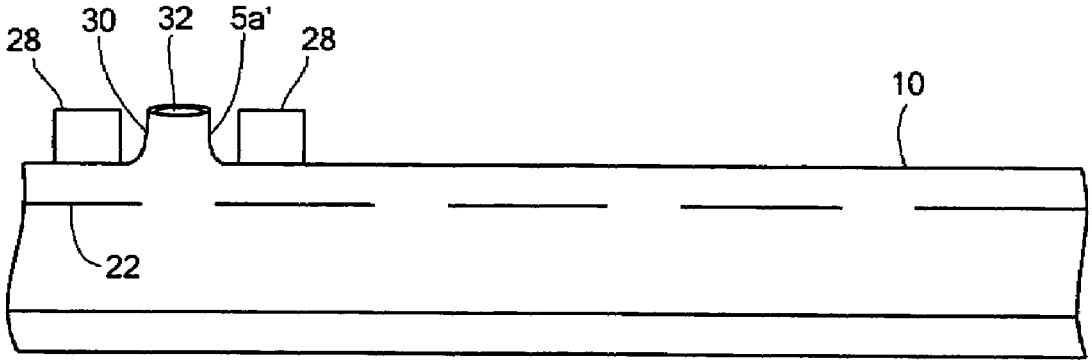
FIG. 3C is a schematic view showing a tone hole approximation now formed in the flute body.
Figure 3D:
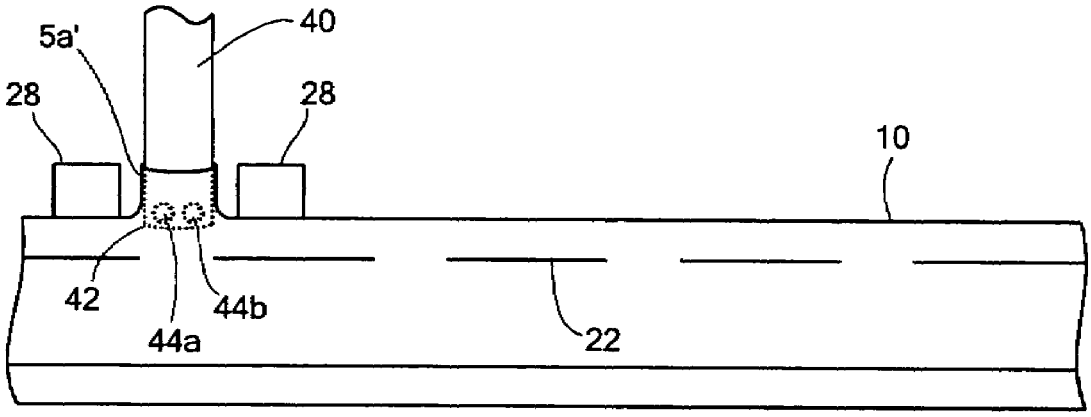
FIG. 3D is a schematic view showing how the forming tool of the subject invention is used to form the completed tone hole.
Figure 3E:
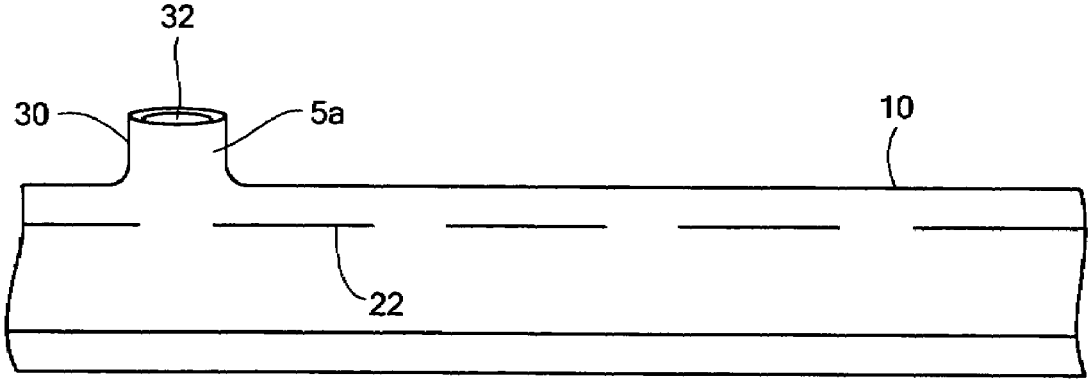
FIG. 3E is a schematic view showing a tone hole now formed in the flute body.

In one preferred embodiment in accordance with the subject invention, the primary tone hole forming operations all take place in a CNC machine. Arbor 22, FIG. 3A is placed in flute body 10 and loaded into a CNC machine where endmill 24 is used to form the pre-openings 12*a* and the like in the flute body. The chip drops down into the hollow arbor and does not interfere with subsequent operations. Next, preforming tool 26, FIG. 3B in combination with die ("chimney") 28 is used to form tone hole approximation 5*a*', FIG. 3C. The side wall 30 of tone hole approximation 5*a*' is not yet true and the opening 32 may be 0.045" or more too small (e.g., 0.510" in diameter). Next, forming tool 40, FIG. 3D is inserted into the flute body transversely into the flute body through tone hole approximation 5*a* with the distal end 42 of forming tool 40 in its contracted configuration and ball bearings 44*a*, 44*b* recessed. Then, forming tool 40 is reconfigured into its expanded configuration with ball bearings 44*a*, 44*b* driven outward and forming tool 40 is withdrawn (e.g., rotated and pulled) out of body 10 through chimney 28 to form tone hole 5*a*, FIG. 3E now with true side wall 30 and opening 32 both meeting the specified tolerances (e.g., opening 32 is now 0.555" in diameter). In the same manner, all the tone holes are so formed within the same CNC machine using the same forming tool for forming some tone holes and different diameter forming tools of the same basic configuration for forming other tone holes. After withdrawing chimney 28, finishing work, such as machining the top of a tone holes (facing) and rolling the edges of the tone holes, can also take place in the same CNC machine.

Figure 4:
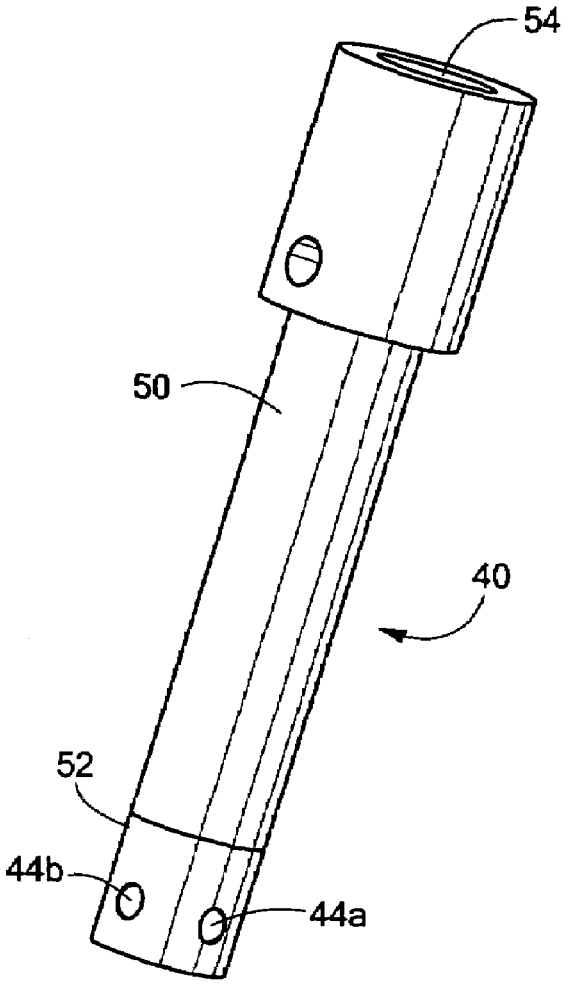
FIG. 4 is a schematic three-dimensional front view showing a preferred embodiment of a tone hole forming tool in accordance with the subject invention.
Figure 5:
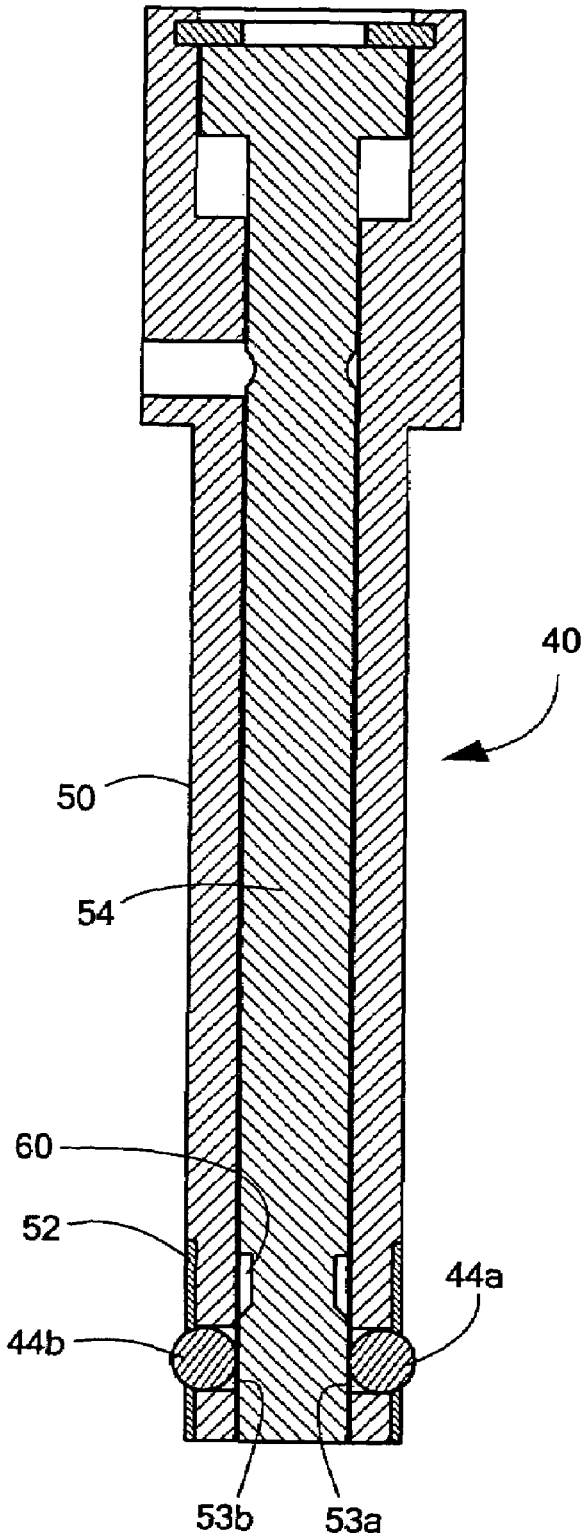
FIG. 5 is a schematic cross-sectional view of the tone hole forming tool shown in FIG. 4.
Figure 6:
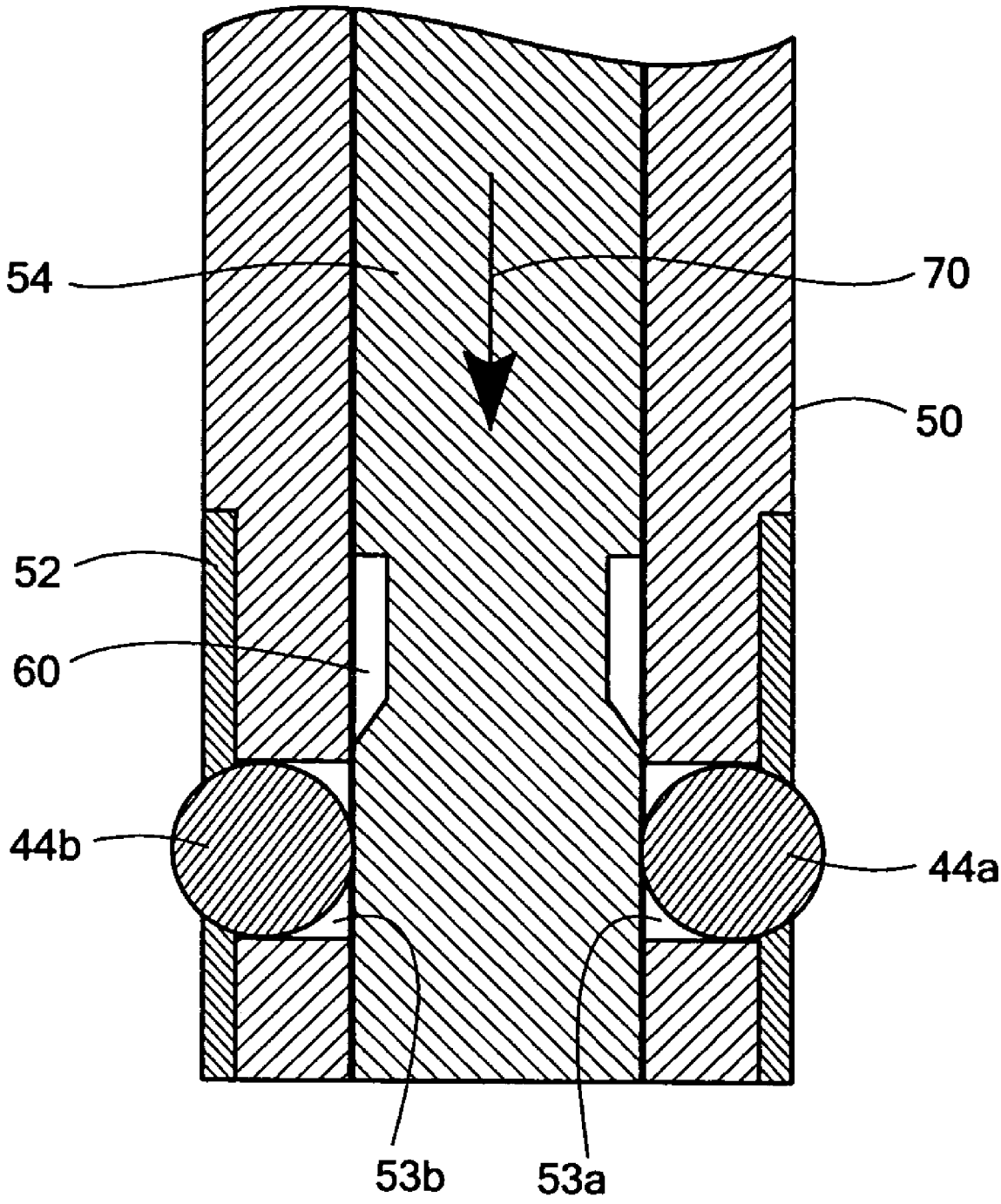
FIG. 6 is a schematic cross-sectional view showing the distal end of the forming tool shown in FIGS. 4 and 5.

The preferred tone hole forming tool includes shaft 50, FIGS. 4-6 with distal end 52 to be inserted transversely into the body of a musical instrument as discussed above. Distal end 52 includes sockets 53 (see FIG. 6) spaced about its periphery (e.g., 4 or 5 sockets) and ball bearings 44*a*, 44*b*, and the like mounted in the sockets. Shaft or plunger 54 is movable within body 50 (either by mechanical action or pneumatically, for example) in order to contract and expand the bearings. As shown more clearly in FIG. 5, shaft 54 includes reduced diameter distal portion 60 which may be continuous in the form of a groove extending circumferentially around the distal end of shaft 54 or, instead, may be discrete spaced pockets for receiving the bearings. In either case, when shaft 54 is in the position shown in FIG. 6, ball bearings 44*a*, 44*b* are driven outward from the periphery of body 50 rendering the distal end 52 of body 50 the proper size of the resulting tone hole (e.g., in the example above, 0.555" in diameter). When shaft 54 is moved either mechanically or pneumatically in the direction of arrow 70, FIG. 6, ball bearings 44*a*, 44*b* are free to retract into groove 60 rendering them flush, or nearly flush, with the periphery of body 50 allowing 0.500" diameter body 50 to be inserted into a tone hole approximation (see FIG. 3D). When shaft 54 is then moved opposite the direction of arrow 70, ball bearings 44*a*, 44*b* are driven outward from the periphery of the shaft to form the tone hole as body 50 is rotated and pulled out of the flute body.

Typically, all the components of tool 40, FIG. 4 are made of metal (e.g. hardened steel). In one example, to form one exemplary tone hole, body 50 had an outer diameter of 0.500", an inner diameter of 0.250", shaft 54 had an outer diameter of 0.250", and ball bearings 44 had a diameter of 0.156". The dimensions in the example above, however, are exemplary only and different diameter tools can be used to form different diameter tone holes. Also, the bearings used need not be round and instead could be cylindrical in shape, cone shaped, or configured in other shapes.

The result is a robust tool useful in a CNC machine where, according to one preferred embodiment of this invention, most or even all of the steps associated with forming tone holes can take place. Note that in accordance with the prior art, FIG. 2B, a pulling ball 14 had to be manually inserted into the open end of flute body 10, screwed on the shaft 18, pulled out, removed from shaft 18, and reinserted in the flute body 10, and then re-attached to shaft 18 four times to produce four tone holes. In accordance with the subject invention, in contrast, all the tools shown in FIGS. 3A-3E including forming tool 40, FIG. 3D can be automatically retrieved and used by a properly programmed CNC machine. The result is a serious labor and cost savings.

In the prior art, forming a tone hole cannot take place in one machine because, when the holes are drilled, the chips would fall directly on the pulling ball beneath the hole. The chips would then interfere with the quality formation of a tone hole. In the subject invention, the chips fall into hollow arbor 22, FIG. 3A. Since performing tool 26, FIG. 3B comes from the outside instead of the inside, the chips never interfere with the quality formation of the tone hole. Also, chimney 19, FIG. 2B typically gets in the way of facing and rolling. In the subject invention, chimney 28, FIG. 3 is removable while the flute and arbor remain in the existing setup, thus allowing facing and rolling to be accomplished in the same setup as hole piercing and tone hole extrusion. Generally, though not necessarily, rolling requires that the extruded tone hole be allowed to "float" in order for the rolling tool to be exactly centered in the extruded tone hole. Floating is desirable because the rolling operation is extremely sensitive to the slightest off centering and because, when the rolling setup is different than the extrusion setup, the center is likely to be slightly off. Better quality tone holes are produced by the tool of this invention because there is relatively more spinning force and less extrusion force than in the prior art. In addition, the spinning force is achieved by rotating ball bearings 44 washed in coolant, as opposed to the prior art where a fixed pulling ball with a lubricant was employed. It is believed a process which favors spinning forces over extrusion forces produces a higher quality surface finish on the inside of the tone hole, as well as less distortion to the flute tube surrounding the extruded tone hole due to the gentler, less stressful technique. One other consideration with regard to quality is that a fixed pulling ball tends to "load up" with dust or grit coming off the inside of the tone hole being extruded. This build up of metal dust starts to interfere with subsequent pulls, and thus requires the fixed pulling ball to be regularly cleaned, often manually. Using the process of this invention, there is much less metal dust build up since the ball bearings rotate freely, and whatever dust does build up is cleansed by the flood coolant of the CNC.

Although specific features of the invention are shown in some drawings and not in others, this is for convenience only as each feature may be combined with any or all of the other features in accordance with the invention. The invention applies to musical instruments other than flutes, for example. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A musical instrument tone hole forming tool comprising:

a body including a distal end to be inserted a musical instrument through an opening therein;

the distal end of the body including sockets spaced about its periphery;

bearings in the sockets; and a shaft moveable within the body including reduced diameter distal portions which receive the bearings in a contracted configuration in order to insert the body into the musical instrument, the shaft driving the bearings outward from the distal end of the body in an expanded configuration to form a tone hole when the body is withdrawn out of the musical instrument body.

2. The tool of claim 1 in which the bearings are flush with the periphery of the body when received in the reduced diameter portions of the shaft.

3. The tool of claim 1 in which the bearings are ball shaped.

4. The tool of claim 1 in which the reduced diameter distal portions of the shaft are configured as a groove extending circumferentially around the distal end of the shaft.

5. The tool of claim 1 in which the body has an outer diameter of 0.500", an inner diameter of 0.250", the shaft has an outer diameter of 0.250", and the bearings are balls 0.156" in diameter.

6. The tool of claim 1 in which the body, the shaft, and the bearings are made of metal.

7. A method of forming a tone hole in a musical instrument, the method comprising:

forming an opening transversely through the body of the musical instrument;

inserting a forming tool into the opening, the forming tool comprising:

a body including a distal end to be inserted into the musical instrument through the opening, the distal end of the body including sockets spaced about its periphery, bearings in the sockets, and a shaft moveable within the body including reduced diameter distal portions which receive the bearings in a contracted configuration in order to insert the body into the musical instrument body;

moving the shaft to drive the bearings outward; and withdrawing the forming tool out of the musical instrument body to form a tone hole.

8. The method of claim 7 in which the bearings are flush with the periphery of the body when received in the reduced diameter portions of the shaft.

9. The method of claim 7 in which the bearings are ball shaped.

10. The method of claim 7 in which the reduced diameter distal portions of the shaft are formed in a groove extending circumferentially around the distal end of the shaft.

11. A hole forming tool comprising:

a body including a distal end to be inserted in a tube through an opening therein;

the distal end of the body including sockets spaced about its periphery;

bearings in the sockets; and a shaft moveable within the body including reduced diameter distal portions which receive the bearings in a contracted configuration in order to insert the body into the tube, the shaft driving the bearings outward from the distal end of the body in an expanded configuration to form a rim about the hole when the body is withdrawn out of the tube body.

* * * * *